US011647795B2

(12) United States Patent
Campitelli

(10) Patent No.: US 11,647,795 B2
(45) Date of Patent: May 16, 2023

(54) SURFACE CHANGING AEROSOL-GENERATING SYSTEM

(71) Applicant: PHILIP MORRIS PRODUCTS S.A., Neuchâtel (CH)

(72) Inventor: Gennaro Campitelli, Neuchâtel (CH)

(73) Assignee: Philip Morris Products S.A., Neuchatel (CH)

( * ) Notice: Subject to any disclaimer, the term of this patent is extended or adjusted under 35 U.S.C. 154(b) by 268 days.

(21) Appl. No.: 16/957,662

(22) PCT Filed: Nov. 21, 2018

(86) PCT No.: PCT/IB2018/059152

§ 371 (c)(1),
(2) Date: Jun. 24, 2020

(87) PCT Pub. No.: WO2019/130128

PCT Pub. Date: Jul. 4, 2019

(65) Prior Publication Data

US 2020/0329774 A1 Oct. 22, 2020

(30) Foreign Application Priority Data

Dec. 28, 2017 (EP) ..... 17210858

(51) Int. Cl.

| | |
|---|---|
| ***A24F 40/53*** | (2020.01) |
| ***A24F 40/42*** | (2020.01) |
| ***A24F 40/51*** | (2020.01) |
| ***A24F 40/40*** | (2020.01) |

(Continued)

(52) U.S. Cl.

CPC ..... *A24F 40/53* (2020.01); *A24F 40/40* (2020.01); *A24F 40/42* (2020.01); *A24F 40/51* (2020.01); *A24F 40/60* (2020.01); *A24F 40/10* (2020.01)

(58) Field of Classification Search

None

See application file for complete search history.

(56) References Cited

U.S. PATENT DOCUMENTS

| | | | |
|---|---|---|---|
| 11,229,239 | B2 | 1/2022 | Galloway et al. |
| 2015/0020825 | A1 | 1/2015 | Galloway et al. |

(Continued)

FOREIGN PATENT DOCUMENTS

| | | | |
|---|---|---|---|
| CN | 102481021 | A | 5/2012 |
| CN | 103092335 | A | 5/2013 |

(Continued)

OTHER PUBLICATIONS

International Preliminary Report on Patentability for PCT/IB2018/059152, issued by the International Bureau of WIPO dated Jul. 9, 2020; 7 pgs.

(Continued)

*Primary Examiner* — Phu H Nguyen

(74) *Attorney, Agent, or Firm* — Mueting Raasch Group

(57) ABSTRACT

An aerosol-generating system includes an aerosol-generating article (100) comprising an article housing (110) and an aerosol-forming substrate (300) disposed in the article housing. The system further includes an aerosol-generating device (200) comprising a device housing (210) that defines a receptacle (220) configured to receive the aerosol-generating article. The device further includes control electronics (250) disposed in the device housing and includes a sensor (260) operably coupled to the control electronics and configured to detect a state of the device or the article when the article is received in the receptacle. In addition, the system includes a shape-changing element (270) disposed on or in at least one of the article housing and the device housing. The shape-changing element changes shape in response to the state of the device or the article detected by the sensor to cause a sufficient change in shape of an exterior surface of the device or the article to provide tactile feedback to a user.

16 Claims, 7 Drawing Sheets

(51) Int. Cl.
*A24F 40/60* (2020.01)
*A24F 40/10* (2020.01)

(56) References Cited

U.S. PATENT DOCUMENTS

| | | | |
|---|---|---|---|
| 2015/0359263 | A1 | 1/2015 | Galloway et al. |
| 2016/0374400 | A1 | 12/2016 | Monsees et al. |
| 2017/0055580 | A1 | 3/2017 | Blandino et al. |
| 2017/0150757 | A1 | 6/2017 | Worm et al. |
| 2017/0256144 | A1 | 9/2017 | Khoshkava et al. |

FOREIGN PATENT DOCUMENTS

| | | | |
|---|---|---|---|
| CN | 107168512 | A | 9/2017 |
| EP | 2581807 | A1 | 4/2013 |
| RU | 2604012 | | 12/2016 |
| RU | 2637980 | | 11/2017 |
| WO | WO 2011/028372 | A1 | 3/2011 |
| WO | 20130076098 | | 5/2013 |
| WO | 20150071682 | | 5/2015 |
| WO | WO 2016/156497 | A1 | 10/2016 |
| WO | WO 2017/122196 | A1 | 7/2017 |
| WO | WO 2017/186477 | A1 | 11/2017 |

OTHER PUBLICATIONS

International Search Report and Written Opinion for PCT/IB2018/059152, issued by the European Patent Office, 14 pgs.
European Search Report for EP 17210858.1, issued by the European Patent Office, 9 pgs.
Russian Office Action issued for RU 2020118344 by the Patent Office of the Russian Federation, dated Mar. 2, 2022; 13 pgs. including English translation.

SURFACE CHANGING AEROSOL-GENERATING SYSTEM

This application is the § 371 U.S. National Stage of International Application No. PCT/IB2018/059152, filed 21 Nov. 2018, which claims the benefit of European Application No. 17210858.1, filed 28 Dec. 2017.

The present disclosure relates to aerosol-generating systems comprising aerosol-generating devices and aerosol-generating articles associated with the aerosol-generating devices, and particularly to aerosol-generating systems comprising devices and articles having a surface that changes shape in response to a parameter associated with the device or the article.

A number of aerosol-generating articles in which an aerosol-forming substrate, such as tobacco, is heated rather than combusted are known or have also been proposed in the art. In such articles, the aerosol is generated by heating the aerosol-forming substrate. Known heated aerosol-generating articles include, for example, articles in which an aerosol is generated by electrical heating. In use, volatile compounds are released from the aerosol-forming substrate when heated and are entrained in air drawn through the article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Such aerosol-generating articles are typically employed with aerosol-generating devices that include a power supply and suitable electrical components to, for example, heat the aerosol-forming substrate of the aerosol-generating article to an extent sufficient to generate an aerosol without combusting the substrate.

Other aerosol-generating devices, such as electronic cigarettes, are known to use aerosol-generating articles that include a liquid aerosol-forming substrate. The aerosol-generating article is typically a cartridge that contains the liquid aerosol-forming substrate. The device may include a power supply, such as a battery, control electronics, and an electrically operated aerosolizer. In some cases, the cartridge may include the electrically operated aerosolizer. A cartridge that includes both a supply of aerosol-forming substrate and an aerosolizer is sometimes referred to as a "cartomizer". The aerosolizer may comprise a coil of resistive wire wound around an elongate wick soaked in liquid aerosol-forming substrate. Applying current to the resistive wire may heat the aerosol-forming substrate to form an aerosol that may be inhaled by a user.

Additional aerosol-generating devices may use aerosol-generating articles that include a gel that may be heated to generate an aerosol for inhalation by a user. Other aerosol-generating devices may use aerosol-generating articles that include a powder that may be inhaled by a user.

Such aerosol-generating devices and articles have different intrinsic states and parameters of which their users may wish to be informed. For example, a user may wish to be informed of the battery level of an aerosol-generating devices that employs a battery so that the user may plan when to charge the battery in relation to the time they plan to use the device.

Other useful information may be, for example, vapor or particle level or other parameters that may be adjusted with the use of such devices.

In addition, a user may find useful information regarding a consumable aerosol-generating article, such as flavour, brand, etc., in the device. Users usually know this information at the time of insertion or refill of the consumable article. However, after a while or if the user has several aerosol-generating devices, a reminder of a parameter of the consumable article that is presently inside an aerosol-generating device may be useful to a user.

With some aerosol-generating devices, information regarding the device or corresponding article may be displayed visually. For example, the device may include light emitting diodes (LEDs) that may be illuminated, for example, when the battery charge level is low. Devices may include a display, such as a liquid crystal display (LCD), that may provide information regarding a parameter of the device or corresponding article.

However, aerosol-generating devices are often put in pocket or bag, requiring a user to remove the device from their bag or pocket to see the visual cue regarding the status of the device. At times, it may be inconvenient to remove the device to check the status. In some instances, a user may wish to check the status of their device without making the aerosol-generating devices visible to other people who may be in the vicinity.

Some aerosol-generating devices vibrate to communicate status with users. However, vibrations may be disturbing and invasive when unexpected. Furthermore, vibrations typically are sent in short bursts which limit the time the information is available. If the aerosol-generating device is in, for example, a user's bag, there may be a low probability that a user would receive information from vibrations even if the user physically checks the aerosol-generating device from time to time, unless, by chance, the user places their hand on the device while the vibrations are occurring. Additionally, a user may become annoyed by repeated bursts of vibrations indicating a status of the device, if the user has already received the information.

Some aerosol-generating devices communicate status with users through the use of sound. Communication by sound may suffer from many of the drawbacks of communication by vibration. For example, the communicated information may be limited in time and not continuous, the information may not be discreet, or may become annoying if delivered after the user has already received the information, and the like.

It would be desirable to provide an aerosol-generating device capable of providing information to user that may be interpreted without vibration, sound, or purely visible cue.

In various aspects of the present invention there is provided an aerosol-generating system comprising at least one of an aerosol-generating device and an aerosol-generating article associated with the aerosol-generating device having an exterior surface capable of changing shape in response to a detected state of the aerosol-generating device or an aerosol-generating article associated with the device. Accordingly, there is also provided an aerosol-generating device having an exterior surface capable of changing shape in response to a detected state of the aerosol-generating device or an aerosol-generating article associated with the device. There is also provided an aerosol-generating article for use with an aerosol generating device, where the article has an exterior surface capable of changing shape in response a detected state of the aerosol-generating article or an aerosol-generating device associated with the article. The change in shape of the shape-changing element may cause a sufficient change in shape of at least one of an exterior surface of the device and an exterior surface of the article to provide tactile feedback to a user. Typically, the shape-changing element causes an exterior surface of at least one of the housing of the device and the housing of the article to change shape.

Any change in shape that may be detected by a user touching the device or feeling the device is sufficient to provide tactile feedback to the user.

The article comprises an article housing and an aerosol-forming substrate disposed in the article housing. The device comprises a device housing that defines a receptacle configured to receive the aerosol-generating article. The device further comprises control electronics disposed in the device housing. The device also comprises a sensor operably coupled to the control electronics and configured to detect a state of the device or an article received in the receptacle. In addition, at least one of the device and the article comprises a shape-changing element disposed on or in the housing. The control electronics are operably coupled to the shape-changing element and are configured to cause the shape-changing element to change shape in response to the state of the device or the article detected by the sensor. The change in shape or resulting shape of the exterior surface of at least one of the device and the article may provide a user of the device with information regarding the state of the device or an article associated with the device, such as an article received in the receptacle.

Various aspects or embodiments of the aerosol-generating devices described herein may provide one or more advantages relative to currently available or previously described devices that provide information regarding a state of the device or of an aerosol-generating article associated with the device. For example, by changing the shape of an exterior surface of the device, as opposed to providing a purely visual cue as with LEDs or LCDs, the user may be informed of the state of the device or associated article through tactile feedback, without having to view the article. By changing the shape of an exterior surface of the device, as opposed to a vibratory cue or an auditory cue, the user is not inconvenienced by repeated potentially unwanted signals of the state of the device or associated article.

Various aspects or embodiments of the aerosol-generating articles described herein may provide one or more advantages relative to currently available or previously described articles that provide information regarding a state of the article. For example, by changing the shape of an exterior surface of an aerosol-generating article, the article may provide information regarding the state of the article, such as the amount of aerosol-forming substrate remaining in the article or the number of puffs taken on the article.

Any suitable aerosol-generating device may include a shape-changing element to change a shape of an exterior or outer surface of the device to provide a user information regarding a state of the aerosol-generating device or an associated aerosol-generating article. The aerosol-generating device may be configured for use with any suitable aerosol-generating article, such as a cartridge comprising a liquid substrate, a cartridge comprising a solid substrate, a cartridge comprising a gel substrate, or a cartridge comprising a powder substrate. For example, the device may be an electronic cigarette-type device, a heat-not-burn type device, or the like. The device may be similar to Philip Morris International's I-QOS® aerosol-generating device which may receive a cartridge such as Philip Morris International's HEATSTICKS® or HEETS® articles, which contain an aerosol-forming substrate comprising tobacco. The I-QOS® aerosol-generating device heats the aerosol-forming substrate of the HEATSTICKS® or HEETS® articles to a temperature to sufficient to generate aerosol from the substrate without combusting the substrate. The device may be similar to NICOCIG® e-cigarette that may be used with any suitable cartridge comprising e-liquids or may be similar to Philip Morris International's MESH® system comprising e-liquid-containing cartridges.

Similarly, any suitable aerosol-generating article may include a shape-changing element to change a shape of an exterior or outer surface of the article to provide a user information regarding a state of the aerosol-generating article or the aerosol-generating device associated with the article. The aerosol-generating article may be any suitable aerosol-generating article, such as a cartridge comprising a liquid substrate, a cartridge comprising a solid substrate, a cartridge comprising a gel substrate, or a cartridge comprising a powder substrate. The aerosol-generating article may be configured for use with any suitable aerosol-generating device.

Regardless of the type of aerosol-generating device or aerosol-generating article, the shape-changing element may change shape in response to any suitable state of the aerosol-generating device or the associated aerosol-generating article. For example, the shape-changing element may change shape in response to a change in charge level (state of charge) of a power supply of the device, the type or aerosol-generating article received in the receptacle of the device, the amount of aerosol produced during use of the device, or the like.

The shape-changing element may change the shape of the exterior surface of the aerosol-generating device or the exterior surface of the aerosol-generating article in any suitable manner. For example, the shape-changing element may affect a global change in the shape of the surface of the device or the article, may affect a local change in the shape of the surface of the device or the article, may affect a texture of the surface of the device or the article, or the like.

The shape-changing element may be disposed on an outer surface of the article housing or on the outer surface of the device housing.

The change in shape of the exterior surface may provide a tactile cue to a user regarding the state of the device or an associated aerosol-generating article. The change in shape may also, in some instances, provide a visual cue to the user. Accordingly, in some situations the user may view the device to identify the state or may feel the device to identify the state, whichever is more convenient for the user at a given time.

The aerosol-generating system may comprise any suitable shape-changing element. The shape-changing element may comprise a shape-changing material. Any suitable shape-changing material may be used. For example, the shape-changing material may comprise a piezoelectric material, a shape memory alloy, a foam comprising gas bubbles, an electroactive polymer, or the like. A piezoelectric material and an electroactive polymer, for example, may change shape upon application of an electric current or voltage and return to its original shape when the current or voltage is no longer applied. A shape memory alloy and a foam containing gas bubbles may change shape upon application of heat or cold and return to its original shape during return to ambient temperature.

Any suitable piezoelectric material may be used as a shape-changing material. For example, piezoelectric crystals, ceramics, biomaterials, or the like may be used. Examples of piezoelectric materials that may be used include quartz, berlinite ($AlPO_4$), sucrose, Rochelle salt, topaz, tourmaline-group minerals, lead titanate ($PbTiO_3$), langasite ($La_3Ga_5SiO_4$), gallium orthophosphate ($GaPO_4$), lithium niobate ($LiNbO_3$), lithium tantalate ($LiTaO_3$), barium titanate ($BaTiO_3$), lead zirconate titanate ($Pb[Zr_x Ti_{1-x}]O_3$ with $0 \leq x \leq 1$), potassium niobate ($KNbO_3$), sodium tungstate ($Na_2WO_3$), $Ba_2NaNb_5O_5$, $Pb_2KNb_5O_{15}$, zinc oxide (ZnO)-Wurtzite structure, bismuth ferrite ($BiFeO_3$), sodium niobate $NaNbO_3$, bismuth titanate $Bi_4Ti_3O_{12}$, sodium bismuth titanate ($NaBi(TiO_3)_2$), a bulk or nanostructured semiconductor crystal having non-central symmetry, such as the Group III-V and II-VI materials, polyvinylidene fluoride (PVDF), and organic nanostructures, such as self-assembled diphenylalanine peptide nanotubes, and the like. In some embodiments, the piezo electric material expands in volume upon application of an electric current or voltage and may return to a reduced original volume when the current or voltage is not applied.

Any suitable electroactive polymer may be used as a shape-changing material. Electroactive polymers may change shape in response to application of a current or voltage and return to their original shape when the current or voltage is no longer applied. Examples of electroactive polymers include dielectric electroactive polymers and ionic electroactive polymers. Examples of dielectric electroactive polymers include ferroelectric polymers, electrorestrictive graft polymers, and liquid crystal polymers. Examples of ionic electroactive polymers include conductive polymers, ionic polymer-metal composites, and stimuli-responsive gels.

The device may be configured in any suitable manner to apply a current or voltage to the piezoelectric material or the electroactive polymer. For example, the shape-changing element may include two electrodes between which the piezoelectric material or the electroactive polymer may be placed. The electrodes may be operably coupled to the control electronics of the device to control whether, how much, and when a voltage may be applied to the electrodes to affect a change in shape of the piezoelectric material or the electroactive polymer. In some embodiments, a current may be applied directly to the shape-changing material, such as a piezoelectric material, to affect a change in shape. Where the aerosol-generating article comprises the shape-changing element, the article and the device may comprise complimentary electrical contacts that are arranged to be connected when the aerosol-generating article is received by the device to electrically connect the piezoelectric material or the electroactive polymer to the power supply of the device.

Any suitable shape memory alloy may be used as a shape-changing material. In some embodiments, the shape memory allow is a two-way shape memory alloy. Two-way shape memory alloys are materials that can take two different shapes: one shape at lower temperatures; and another shape at higher temperatures. The shape of a two-way shape memory alloy may depend on temperature, which means that a change in temperature will cause changes in the shape of the alloy. The temperatures within the temperature range during which a shape memory alloy changes shape are called the transformation temperatures of the alloy. There is a hysteresis associated with this phase transformation. The magnitude of the hysteresis varies from one alloy system to another, and has typical values ranging from 20° C. to 40° C. The transformation temperatures may be adjusted according to the kind of alloy used, and the transformation temperatures could be chosen from −100 to 100° C. In some embodiments, the shape memory alloy has a transformation temperature in a range from about 40° C. to about 70° C.

Suitable shape memory alloys include noble-metal based shape memory alloys, Cu-based shape memory alloys, Fe-based shape memory alloys, Ni—Ti-based shape memory alloys, and the like. In some embodiments, the shape-changing material comprises a titanium-nickel-copper (Ti-NiCu) shape memory alloy, which alloys may exhibit good fatigue performance allowing a million, ten million, or more, shape transformation cycles.

Any suitable foam comprising gas bubbles may be used as a shape-changing material. The foam may expand in volume when heated and may return to its original volume when cooled to ambient temperature. The foam may be a hermetic foam. The foam may be hermetic such that the gas bubbles may be retained in the foam, or the foam may be placed in flexible hermetic package. The gas bubbles may be air or any other suitable gas that readily expands when heated. The foam may comprise any suitable material, such as polyurethane.

The shape-changing element may comprise a heating element to heat the shape memory alloy or the foam to cause the shape memory alloy of the foam to change shape or expand. The shape memory alloy or the foam may be placed in contact or in proximity to a heating element.

The heating element may comprise, for example, a resistive wire or mesh. The shape memory alloy or foam may be on a resistive substrate, which serves as the heating element. The heating element may be operably coupled to the control electronics of the device to control whether, how much, and when the heating element is heated to cause the change in shape or volume of the shape memory alloy or the foam.

In some embodiments, a currently may be directly applied to the shape-changing material, such as a shape memory alloy, which may serve as a resistor and be heated by the Joule effect. This heating may affect a change in shape of the shape-changing material.

Activation of the shape-changing element by application of heat may result in a rapid change in shape. However, loss of heat following a ceasing of the application of the heat may occur over a longer period of time, as the heat is transferred to, for example, the external environment. Such a situation may be useful when using a shape memory alloy that will not change shape until the transition temperature is reached. A small or minimal amount of energy may be applied to heat the shape memory alloy to a temperature above the transition temperature, and the resulting shape may be retained for a relatively long period of time until the heat dissipates. Accordingly, an extended shape change may be accomplished with a small or minimal energy input.

The shape-changing element, or a portion thereof, may be positioned on or in the housing. In some embodiments, the shape-changing element is positioned between a base layer and an exterior layer of the housing. The base layer may provide structural rigidity to the housing. The exterior layer may be sufficiently flexible to accommodate a change in shape when the shape of the shape-changing element changes. The exterior layer may retain the shape-changing element. The exterior layer may provide, or aid in providing, a hermetic barrier for foam with gas bubbles. The exterior layer may be a coating disposed on the base layer. The exterior layer may be resilient and biased towards a retracted state. The exterior layer may serve as a heat shield to prevent excessive heat transfer from, for example, a resistive element of the shape-changing element to a user touching the housing. In some embodiments, the housing includes an additional heat shield layer between the base layer and the exterior layer. The heat shield layer may also serve to conduct heat over a large area to facilitate cooling of the shape-changing element when a heating element is no longer activated.

The housing may comprise any suitable base layer. For example, the base layer of the housing may be formed of any suitable metallic material, rigid plastic material, or combinations thereof. Examples of suitable metallic materials include stainless steel, aluminium, and the like. Examples of suitable rigid plastic materials include high density polyethylene, polycarbonate, polyamides, polypropylene, and the like.

The housing may include any suitable exterior layer. In some embodiments, the base layer is the exterior layer of the housing. If present, examples of suitable exterior layers include rubbers, thermoplastic elastomers, thermoplastic vulcanizates, thermoplastic urethane, and flexible polyvinyl chloride (PVC). For example, the exterior layer may comprise polyurethane, low density polyethylene, SANTOPRENE® thermoplastic vulcanizate, silicone, PVC including plasticizers, polyethylene propylene diene, and the like.

Any suitable material may be employed in an optional heat shield layer. Suitable materials include thermally conductive polymer materials and metallic foils. Examples of thermally conductive polymeric materials may include polymers containing graphite fibres or metallic particles as additives. Examples of suitable metallic foils include aluminium, copper, and tin foils.

The shape-changing element may include a movable part. The movable part may, in some embodiments, not change shape, but rather move when the shape-changing material changes shape. The movable part may be disposed on or operably coupled to the shape-changing material such that, when the shape-changing material changes shape, the movable part moves. The movable part may be shaped and sized to provide visual or tactile cues to a user. The moveable part may have circular, triangular, square, or other suitably shaped surfaces. In some instances, the movable part may have a surface in the shape of a letter, word, or symbol. The movable part may correspond to dots of a Braille alphabet. The Braille alphabet uses 2 columns having each of 3 or 4 pins. The movable part may be positioned between a base layer and an exterior layer of the housing of the article and the device. The moveable part may be formed of any suitable material. For example, the movable part may be formed of a rigid plastic, metal, or combinations thereof.

The housing of the aerosol-generating device may define a receptacle for receiving an aerosol-generating article. The receptacle is sized and shaped to receive at least a portion of an appropriate aerosol-generating article. The aerosol-generating article may comprise a container configured to be received by the receptacle of the housing and may comprise an aerosol-forming substrate disposed in the container.

Any suitable container may be employed. In some embodiments where the aerosol-forming substrate is a solid substrate, the container may include a wrapper that circumscribes the aerosol-forming substrate. For example, the wrapper may comprise a plug wrap, cigarette paper, or the like. In some embodiments where the aerosol-forming substrate is a liquid substrate, the container may include a plastic or metallic housing to contain the liquid.

Information regarding one or both of the aerosol-generating article and the aerosol-forming substrate in the article may be included an element disposed in, on or around the container. For example, an RFID tag may be placed on the container or an electrical circuit comprising an electrical contact may be disposed on the container. The aerosol-generating device may include an RFID reader or an electrical contact, for example in the receptacle, for electrical connection with the contact of the container. The RFID reader or electrical contact may be operably coupled to control electronics of the aerosol-generating device to receive information regarding one or both of the aerosol-generating article and the aerosol-forming substrate in the article. The sensor may comprise the RFID reader or electrical contact.

The housing of the aerosol-generating device may define a device interior in which at least one of the control electronics and a power supply may be disposed.

The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware. The control electronics may be operably coupled to the power supply.

The aerosol-generating device may comprise any suitable power supply. For example, a power supply of an aerosol-generating device may be a battery, or set of batteries. The batteries or power supply unit may be or more of rechargeable, removable, and replaceable. Any suitable battery may be used.

The control electronics may be configured to regulate the power supply. The power may be supplied to the shape-changing element, or an appropriate portion of the shape-changing element, in any suitable manner, such as in the form of electrical current or a voltage differential, to cause the shape-changing element to change the shape of at least one of the article and the device. The shape-changing element or portion thereof may be coupled to the control electronics through a multiplexor if the system includes a plurality of shape-changing elements. The use of a multiplexor may simplify construction of the device by avoiding the need for separate lines to be run the entire distance to each shape-changing element or portion thereof.

The control electronics and power supply may also control the basic operation of the aerosol-generating device. For example, if the aerosol-generating device operates by heating the aerosol-forming substrate to generate an aerosol for inhalation by a user, the control electronics may be operably coupled to a heating element to control the heating of the aerosol-forming substrate. The device or article may include a resistive heating element operably coupled to the control electronics and power supply. In some embodiments, the device may include an inductive heating coil to inductively heat a susceptor material in contact with, or in proximity to, the aerosol-forming substrate.

The control electronics may include a communication module or suitable circuitry for communicating with an external device, such as a computer or smartphone. The communication may be wireless or wired. At least a portion of the control of the shape-changing element may be programmed by a user of the external device. For example, the way in which the shape-changing elements change a shape of the device may be controlled by the user. A user program the control electronics to associate a particular shape change with a parameter of the device or associated article, allowing the user to personalize the shape change notification. The manufacturer of the device may develop an application that may be run on the external device to allow the external device to interact with, and optionally program, the control electronics as appropriate or desired.

The control electronics may be operably coupled to one or more sensors configured to detect a state of the device or an aerosol-generating article associated with the device. The control electronics may activate a shape-changing element to change the shape of at least one of an external surface of the housing of the device and an external surface of the housing of the article in response to a state detected by a sensor. The aerosol-generating device may comprise any suitable number and type of sensor to identify a status of the device. The type of sensor employed may vary depending to the state of the device or associated aerosol-generating article to be detected.

For example, the device may comprise a sensor configured to detect the charge level or state of charge of a battery or other suitable power supply disposed in the housing. Any suitable sensor may be used to detect the charge level of a battery. For example, the battery charge level sensor may include an ammeter, a voltmeter, a resistance meter, or the like.

The device may comprise a sensor to detect parameters associated with an aerosol-generating article. For example, the type or aerosol-generating article, the brand of aerosol-generating article, the flavour of material in the aerosol-generating article, the amount of aerosol-forming substrate remaining, or the like may be detected. The device may obtain Information regarding the aerosol-generating article in any suitable manner. For example, a direct electrical connection between the control electronics of the device and the aerosol-generating article may be formed with the cartridge when the cartridge is received in the receptacle defined by the housing of the device. Information regarding the article may be transmitted to the control electronics through the direct electrical connection. For example, an interior of the receptacle and an exterior of the aerosol-generating article may include contacts for direct electrical connection of the control electronics of the device to the article. In some embodiments, information regarding the article may be transmitted wirelessly to the device. In some embodiments, the range of wireless transmission is limited so that only information from an article received by the device, as opposed to an article in general proximity to the device, is transmitted to the device. In some examples, the aerosol-generating article comprises an RFID tag and the device comprises an RFID reader.

In some embodiments, the sensor may comprise any suitable optical sensor to detect a visible indicator, such as a barcode, provided on an exterior surface of an aerosol-generating article. The sensor may be arranged to detect a visible indicator on an article when the article is received in the receptacle of the device.

The device may comprise a sensor configured to detect any suitable operation parameter of the device. For example, the amount of aerosol or particulate matter produced as the device is in use may be monitored. Any suitable sensor may be used. For example, the sensor may comprise any suitable optical sensor to detect aerosol or particulate matter concentration through, for example, light scattering or absorption. In some embodiments, a sensor configured to measure capacitance or resistance across a passage through which the aerosol or particulate matter flows may be used to detect concentration of the aerosol or particulate matter generated during use of the device.

In another aspect of the present invention, there is provided an aerosol-generating device comprising: a housing defining a receptacle configured to receive an aerosol-generating article; control electronics disposed in the housing; and a sensor operably coupled to the control electronics. The sensor is configured to detect a state of the device or the article when the article is received in the receptacle. The system further comprises a shape-changing element disposed on or in the housing, and the control electronics are operably couplable to the shape-changing element and are configured to cause the shape-changing element to change shape in response to the state of the device or the article detected by the sensor.

In another aspect of the present invention, there is provided an aerosol-generating article for use with an aerosol-generating device, the article comprising: a housing; an aerosol-forming substrate disposed in the housing; and a shape-changing element disposed on or in the housing. The shape-changing element is operably couplable to control electronics of an aerosol-generating device to cause the shape-changing element to change shape.

Any features described above in relation to one aspect may also be applicable to other aspects of the invention.

Reference will now be made to the drawings, which depict one or more aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

FIG. 1 is a schematic sectional view of an aerosol-generating device and article that may be used in accordance with the present invention FIG. 2A is a schematic sectional view of disconnected parts and cover of an aerosol-generating device and associated aerosol-generating article that may be used in accordance with the present invention.

FIGS. 2B-C are schematic perspective views of an example of an aerosol generating system shown in FIG. 2A. FIG. 2B shows the parts connected and the cover removed. FIG. 2C shows the system with the cover secured in place.

Figure 6A:
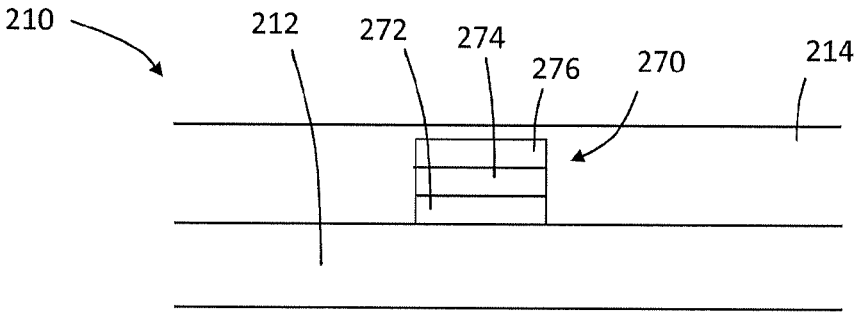
Figure 6B:
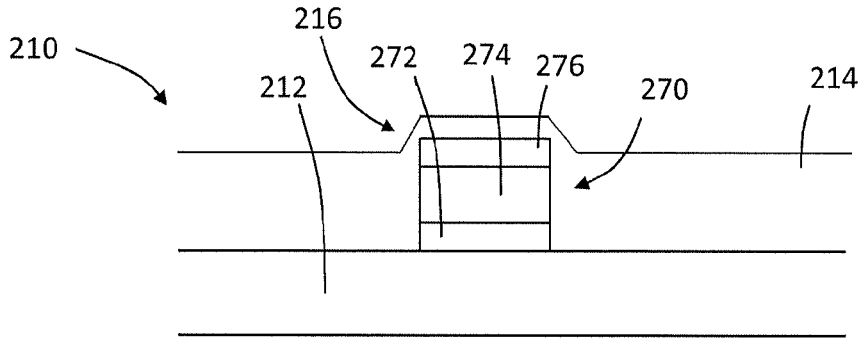

FIGS. 6A-6B are schematic sectional views of a portion of a housing and a shape-changing element disposed in the housing. In FIG. 6A the shape-changing element is in an inactivated state. In FIG. 6B the shape-changing element is in an activated state.

Figure 7A:
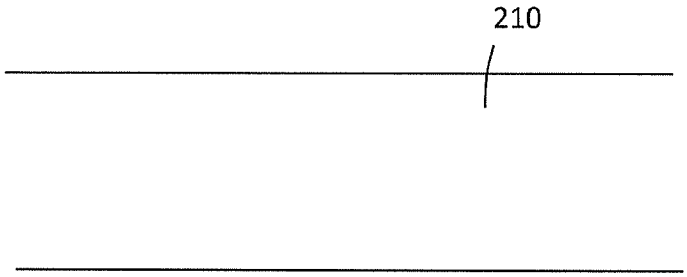
Figure 7B:
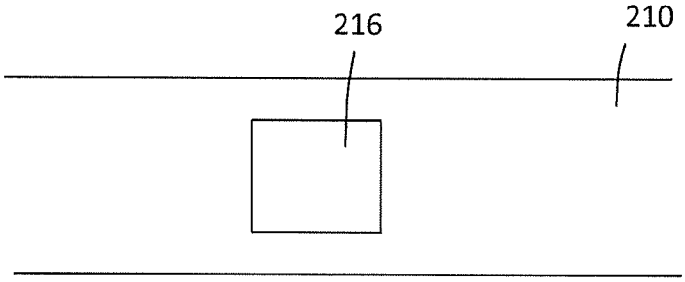

FIGS. 7A-B are schematic top plan views of an embodiment of the portion of a housing depicted in FIGS. 6A-B. FIG. 7A corresponds to FIG. 6A, in which the shape-changing element is in an inactivated state. FIG. 7B corresponds to FIG. 6B, in which the shape-changing element is in an activated state.

Figure 8A:
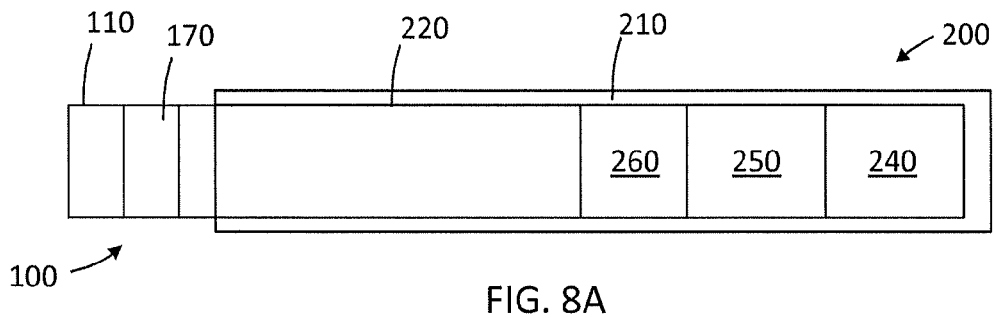
Figure 8B:
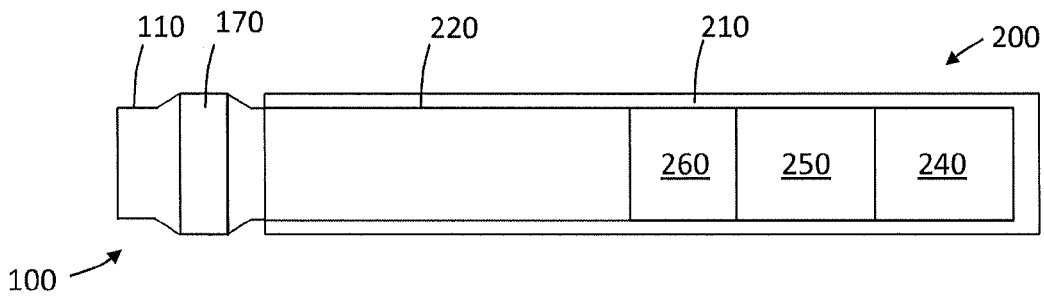

FIGS. 8A-B are schematic sectional views of an aerosol-generating system including an aerosol-generating device and an associated aerosol-generating article having a shape-changing element in an inactivated state (FIG. 8A) and an activated state (FIG. 8B).

Figure 9:
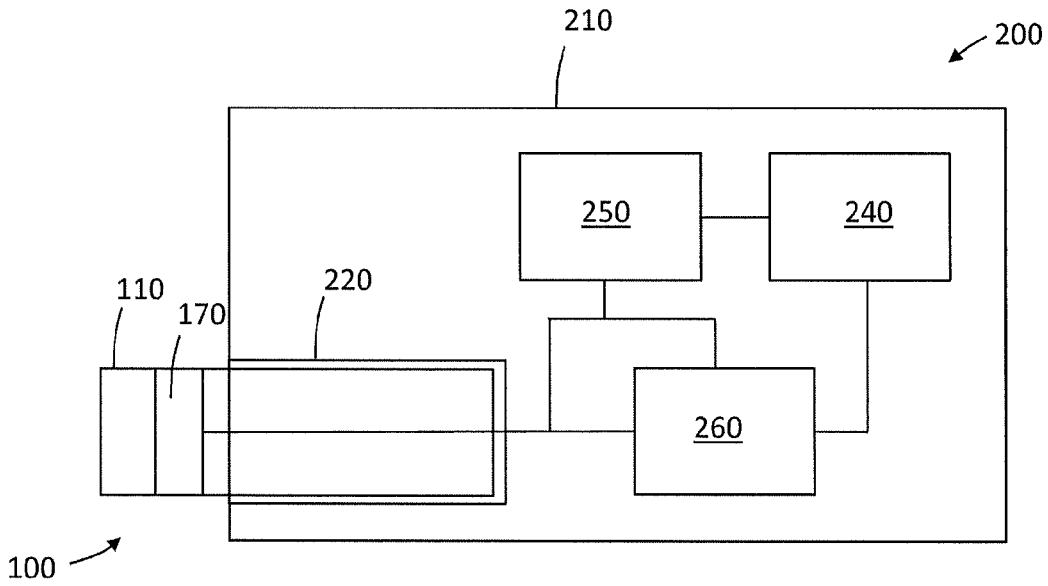

FIG. 9 is a schematic block diagram of an aerosol-generating system including an aerosol-generating device and an associated aerosol generating article having a shape-changing element in an inactivated state.

Figure 1:
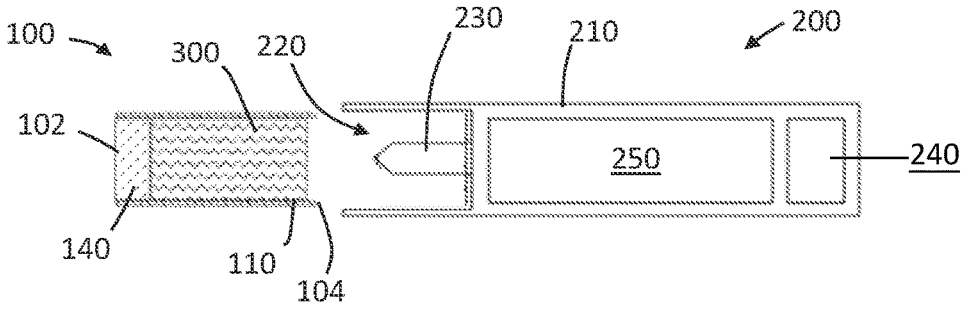

FIG. 1 illustrates a system that includes an aerosol-generating device 200 and associated aerosol-generating article 100 in accordance with an embodiment the present invention. The device 200 includes a housing 210 defining the receptacle 220, which is configured to receive the aerosol-generating article 100. The device 200 also includes an elongate heating element 230 extending into the receptacle 220. The heating element 230 may comprise an electrically resistive heating component. The receptacle 220 has an open end through which the aerosol-generating article 100 may be inserted. The receptacle 220 has a closed end, which the aerosol-generating article 100 may abut when inserted into the receptacle 220. In addition, the device 200 includes a power supply 240 and control electronics 250 disposed in an interior of the housing 210. The power supply 240 and control electronics 250 cooperate to control heating of heating element 230. Preferably, the control electronics 250 are configured to cause the heating element to heat to an extent sufficient to cause aerosol generation from an aerosol-forming substrate of an aerosol-generating article used with the device 200, without combusting the substrate.

The aerosol-generating article 100 comprises a housing 110 in which an aerosol-forming substrate 300 is contained. The housing 110 may be, for example, a wrapper such as a plug wrap or cigarette paper. The aerosol-generating article 100 may include a filter 140, such as a cellulose acetate tow or other suitable filter, at the mouth end 102 downstream of the aerosol-forming substrate 300. The end 104 of the article 100 opposite the mouth end 102 may contact the closed end of the receptacle 220 when the article 100 is inserted in the receptacle 220 of the device 200.

A user may insert the mouth end 102 of the article 100 in his or her mouth and draw on the article 100, which causes air to flow through the article 100. The aerosol-forming substrate 300 is heated by the heating element 230 of the device 200. As the user draws on the mouth end 102 of the article 100, air passes through the heated substrate 300 and aerosol generated from the substrate is entrained in the air being drawn through the article 100. The aerosol entrained in the air being drawn through the article 100 is delivered through the mouth end 102 of the article 100 for delivery to the user by inhalation.

Figure 2B:
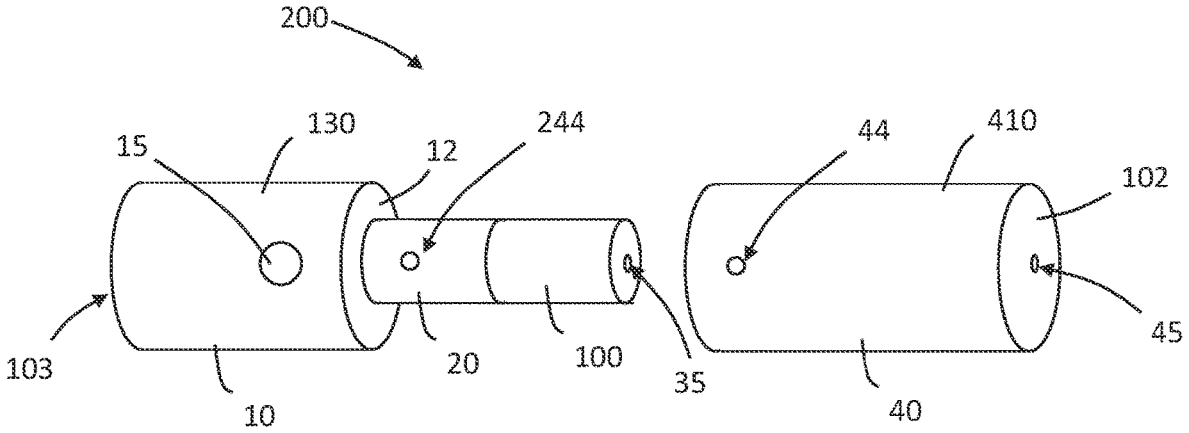
Figure 2C:
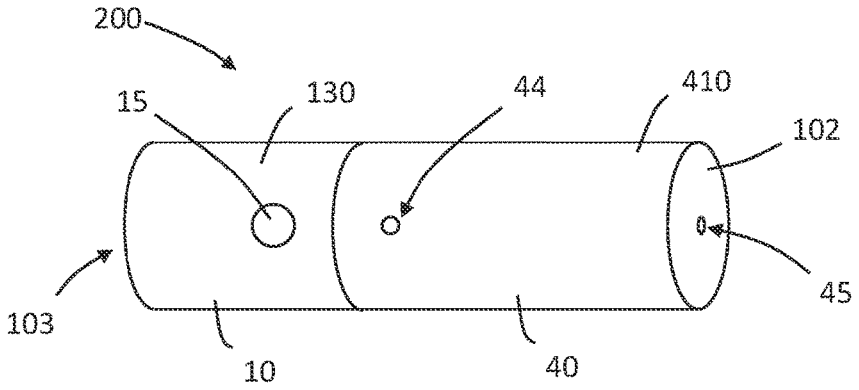
Figure 2A:
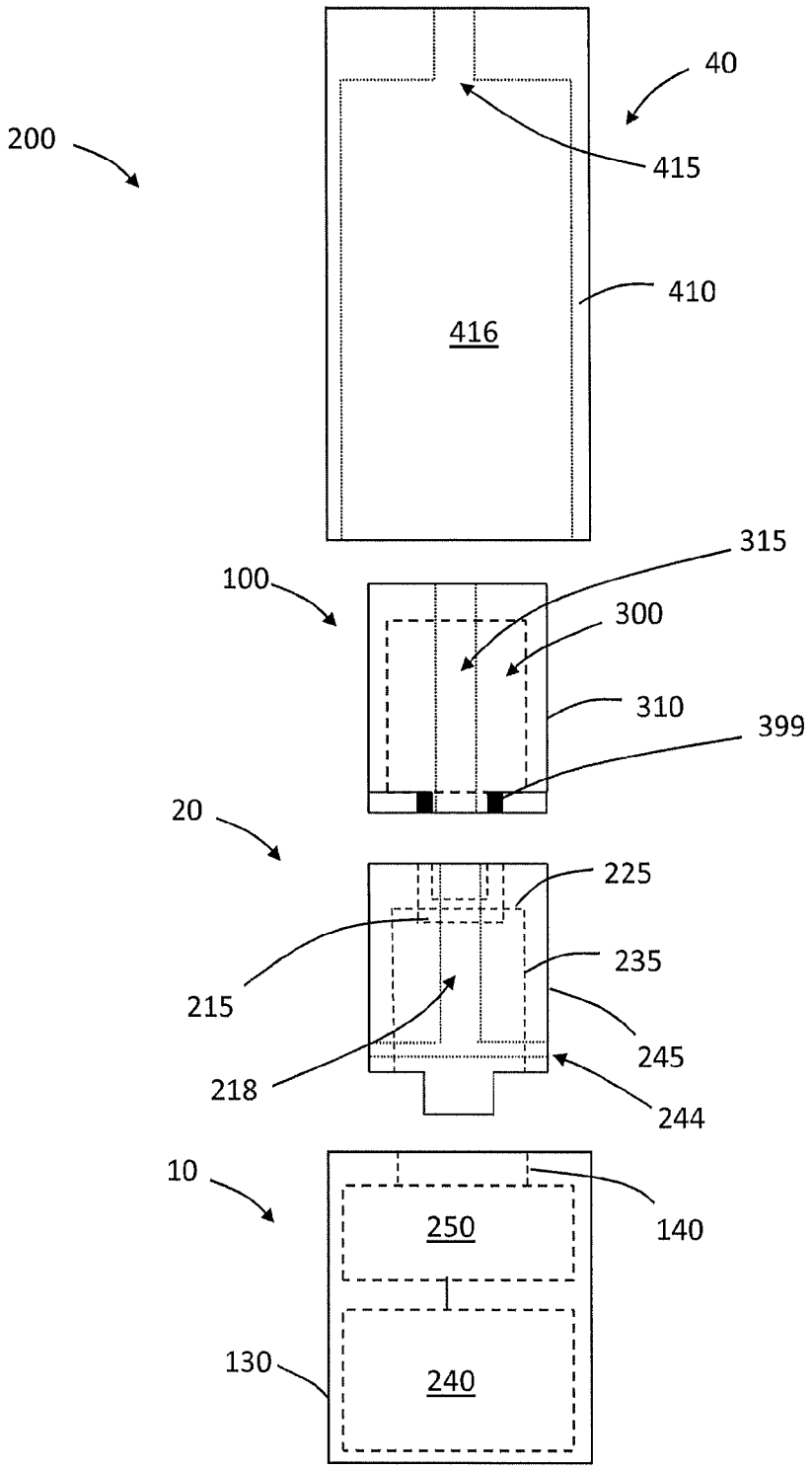

FIGS. 2A-C illustrate a system that includes an aerosol-generating device 200 and associated aerosol-generating article 100 in accordance another embodiment of the present invention. The device 200 includes a first part 10, a vaporizing unit 20, and a cover 40. In this embodiment, the aerosol-generating article 100 is in the form of a capsule comprising a housing 310 defining a reservoir in which a liquid aerosol-forming substrate 300 may be stored.

The first part 10 is releasably connectable to the vaporizing unit 20. The vaporizing unit 20 is releasably connectable to the aerosol-generating article 100. The cover 40 is disposable over the vaporizing unit 20 and aerosol-generating article (capsule) 100. The cover 40 is releasable securable in a position relative to the vaporizing unit 20 and the aerosol-generating article 100. In some examples (not depicted) the components of the vaporizing unit may be included in the aerosol-generating article 100, and the system does not include a separate vaporizing unit.

The first part 10 comprises housing 130 defining an interior in which a power supply 240 and control electronics 250 are disposed. The control electronics 250 are electrically coupled to the power supply 240. Electrical conductors 140 from the control electronics 250 may connect to contacts (not shown) that are exposed through, positioned on, or formed by the housing 130.

The vaporizing unit 20 comprises a housing 245 in which a liquid transfer element 215 and a heating element 225 are disposed. The liquid transfer element 215 is in thermal connection with the heating element 225. Electrical conductors 235 electrically couple the heating element 225 to electrical contacts (not shown) exposed through, or positioned on, or formed by the housing 245. When the vaporizing unit 20 is connected to the first part 10 (for example, as shown in FIG. 2B), the heating element 225 is electrically coupled with the control electronics 250 and power supply 240 via the electrical conductors 235 of the vaporizing unit 20, the electrical conductors 140 of the first part 10 and an electrical connection between the contacts (not shown) of the first part 10 and the vaporizing unit 20.

The aerosol-generating article 100 can be connected to the vaporizing unit 20, for example, by a snap-fit, interference-fit, or any other suitable connection. When the aerosol-generating article 100 is connected to the vaporizing unit 20, the reservoir and thus the aerosol-forming substrate 300 can be either immediately placed, or subsequently engaged, in fluid communication with the liquid transfer element 215. For example, in this embodiment, the aerosol-generating article 100 includes valves 399 configured to be closed when the vaporizing unit and the capsule are not connected and configured to be open when the vaporizing unit and the capsule are connected. The valves 399 are aligned with distal openings in the aerosol-generating article 100 and proximal openings (not shown) in the vaporizing unit 20 such that when the valves 399 are open, liquid aerosol-forming substrate 300 in the reservoir is in communication with liquid transfer element 215.

Also shown in FIG. 2A is a passageway for air or aerosol flow. The vaporizing unit 20 comprises one or more inlets 244 (two shown) in housing 245 in communication with passageway 218 that extends to the proximal end of the vaporizing unit. A central passageway 315 extends through the aerosol-generating article 100 and is in communication with the passageway 218 of the vaporizing unit 20 when the vaporizing unit 20 and the aerosol-generating article 100 are connected. The cover 40 comprises a central passageway 415. The central passageway 415 of the cover 40 is in communication with the central passageway 315 of the aerosol-generating article 100 when the cover 40 is disposed over the article 100.

The cover 40 comprises a housing 410 defining a recess 416 configured to be disposed over the vaporizing unit 20 and the article 100. The cover 40 may be maintained in position in any suitable manner, such as such as threaded engagement, snap-fit engagement, interference-fit engagement, magnetic engagement, or the like to any one or more of the first part 10, vaporizing unit 20, or article 100 (engagement not shown).

FIGS. 2B-C show a schematic perspective view of the aerosol-generating device 200 and associated aerosol-generating article 100 depicted in FIG. 2A. The device 200 shown in FIGS. 2B-C includes a first part 10, a vaporizing unit 20, and a cover 40. The parts are generally as described regarding FIG. 2A. In some examples (not depicted) the components of the vaporizing unit may be included in the aerosol-generating article, and the system would not include a separate vaporizing unit.

The connected system extends from a mouth end 102 to a distal end 103. The housing of the aerosol-generating article 100 defines an opening 35 in communication with a passage through the length of the article 100. The passage defines a portion of an aerosol flow path through the system. The housing of the vaporizing unit 20 defines an air inlet 244 in communication with a passage through the vaporizing unit 20. The passage through the vaporizing unit 20 is in communication with the passage through the aerosol-generating article 100. The cover 40, which is configured to cover the vaporizing unit 20 and the aerosol-generating article 100, comprises a housing 410 having a sidewall defining an air inlet 44 that is in communication with the air inlet 244 of the vaporizing unit 20 when the cover 40 is secured in place relative to the other parts of the system. The housing 410 of the cover 40 also defines a mouth end opening 45 that is in communication with the passage through the aerosol-generating article 100. Accordingly, when a user draws on the mouth end 102, air enters inlet 44 of cover 40, then enters inlet 244 of the vaporizing unit 20, flows through the passage in the vaporizing unit 20, through the passage in the aerosol-generating article 100, through the opening 35 at the proximal end of the article 100, and through the mouth end opening 45.

The first part 10 of the aerosol generating system depicted in FIGS. 2B-C includes a button 15 that may be depressed to activate, and optionally, to deactivate the system. The button 15 is coupled to a switch of the control electronics.

Also shown in the system depicted in FIG. 2B, the housing 130 of the first part 10 defines a rim 12 at the proximal end. The distal end of the cover 40 abuts the rim 12 when the cover 40 is secured in place over the vaporizing unit 20 and the article 100. The housing 410 of the cover 40 and the housing 130 of the first part 10 together form the housing of the aerosol-generating device 200.

The devices 200 depicted in FIGS. 1 and 2A-C are merely examples of aerosol-generating devices that may be employed in accordance with the teachings presented herein. The teachings presented herein are also applicable to any other suitable aerosol-generating device, including devices configured to be used with aerosol-generating articles that include powder or gel substrates.

Figure 3A:
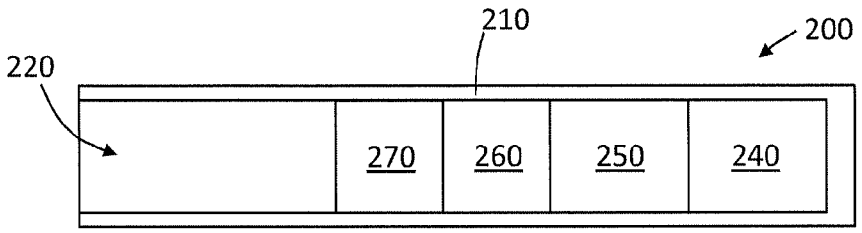
FIGS. 3A-3B are schematic sectional views of an aerosol-generating device having a shape-changing element in an inactivated state (FIG. 3A) and an activated state (FIG. 3B).
Figure 3B:
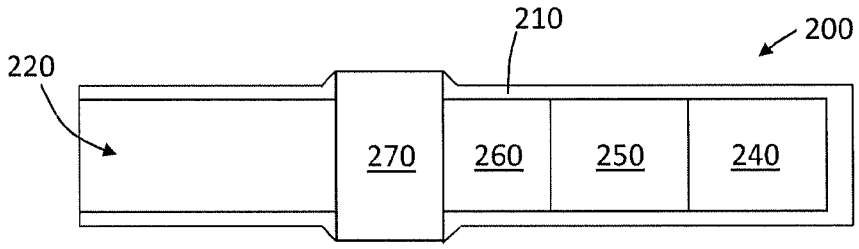
Figure 4A:
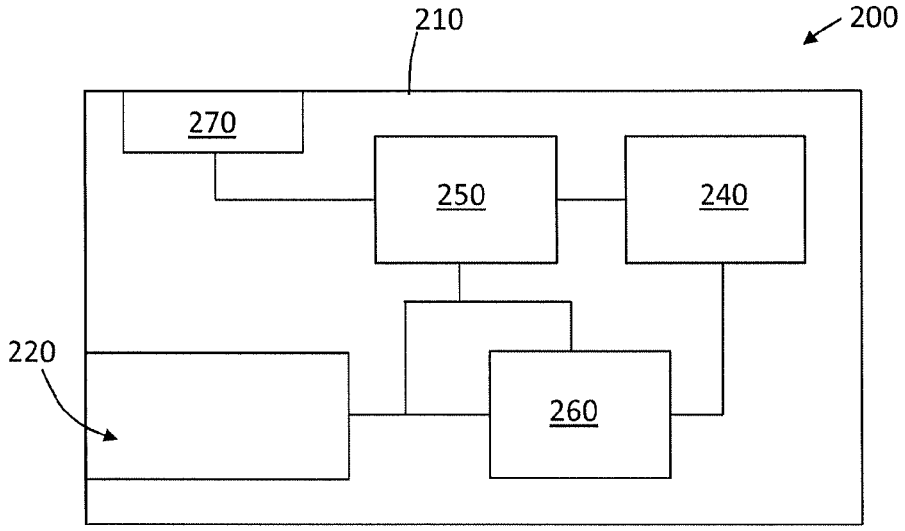
FIGS. 4A-4B are schematic block diagrams of an aerosol-generating device having a shape-changing element in an inactivated state (FIG. 4A) and an activated state (FIG. 4B).
Figure 4B:
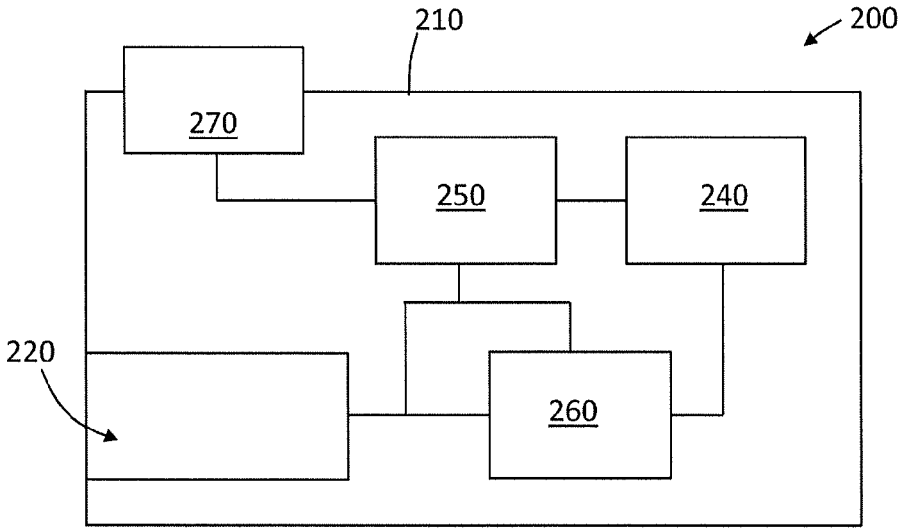

Referring now to FIGS. 3A-B and 4A-B, exemplary non-specific aerosol-generating devices 200 are depicted in schematic form. The devices 200 includes a housing 210 defining a receptacle 220 configured to receive an aerosol-generating article comprising an aerosol-forming substrate. The housing 210 also defines an interior in which control electronics 250 and a power supply 240 are disposed. The device 200 also includes a sensor 260 and shape-changing element 270 configured to change shape when activated by the control electronics 250. The shape-changing element 270 is arranged to change the shape of the device. The control electronics 250 are operably coupled to the power supply 240, the sensor 260, and the shape-changing element 270. The sensor 260 is configured to detect a state of the device 200 or an aerosol-generating article associated with the device 200; e.g., when the article is disposed in the receptacle 220. The control electronics 250 are configured to permit power from the power supply 240 to be supplied to the shape-changing element 270 to activate the shape-changing element 270 when a predetermined state is detected by the sensor 260. Activation of the shape-changing element 270 causes an exterior shape of the device 200 to change. Compare, for example, FIG. 3B, in which the shape-changing element 270 is activated to FIG. 3A, in which the shape-changing element 270 is not activated. Similarly, for example, compare FIG. 4B, in which the shape-changing element 270 is activated to FIG. 4A, in which the shape-changing element 270 is not activated. In the depicted embodiments, activation (such as application of an electrical current a voltage differential) of the shape-changing element 270, or a portion thereof, causes an increase in the volume of the shape-changing element 270, or a portion thereof, which causes a change in shape of the device 200. The shape-changing element 270 of the device of FIGS. 3A and 3B is arranged to deform the housing 210 around the entire circumference the device 200, along a portion of the length of the device 200, to change the exterior shape of the device 200. The shape-changing element 270 of the device of FIGS. 4A and 4B is arranged at one particular side of the device 200 to change the exterior shape of the device at that particular side when the shape-changing element is activated.

The device 200 may include more than one sensor 260 positioned and configured to detect a state of the device. For example, a sensor 260 may be operably coupled to the power supply 240 to measure a charge level of the power supply. A sensor 260 may be operably couplable to an aerosol-generating article when the article is inserted into the receptacle 220 of the device. A sensor 260 may be positioned and configured to detect amount or concentration of aerosol or particles flowing through a mouth end of the device 200.

Figure 5A:
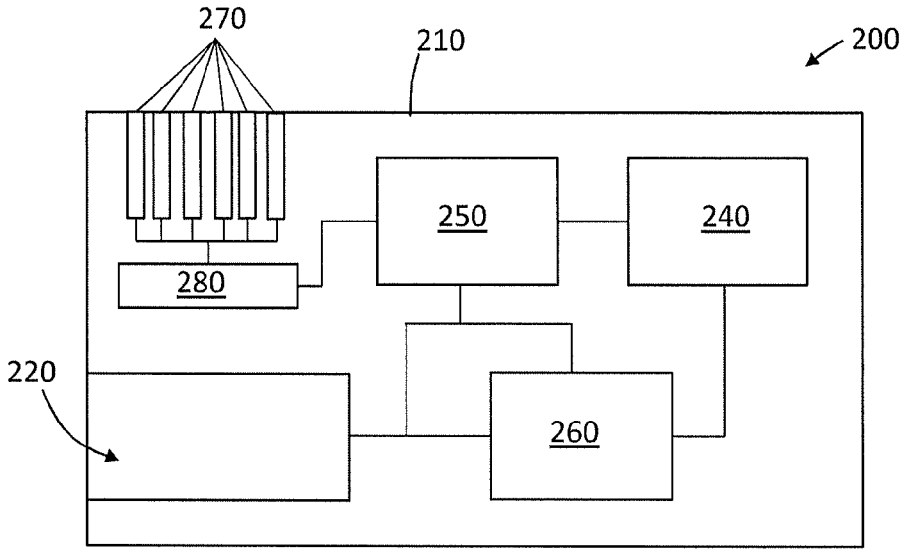
FIGS. 5A-5B are schematic block diagrams of an aerosol-generating device having a shape-changing element in an inactivated state (FIG. 5A) and an activated state (FIG. 5B).
Figure 5B:
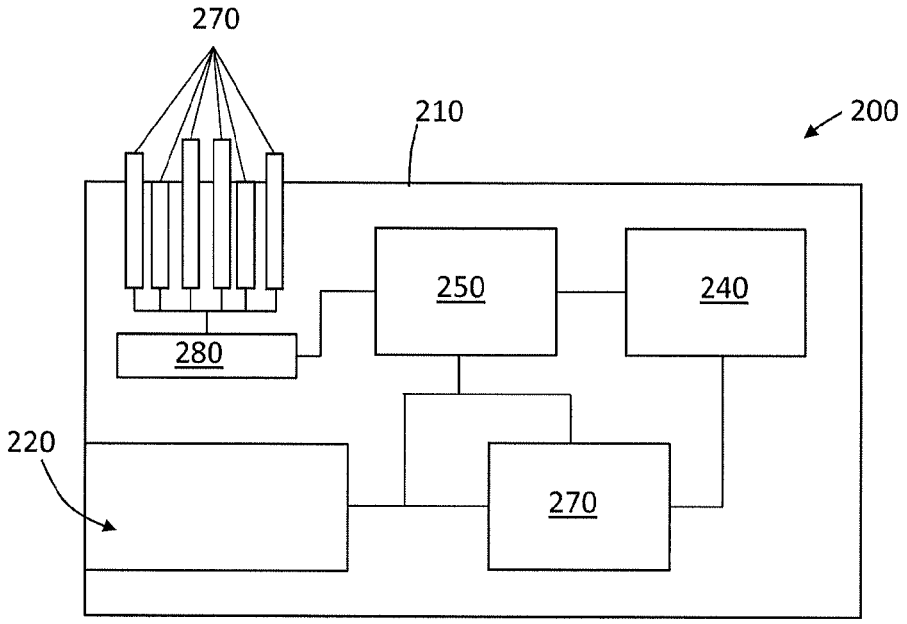

FIGS. 5A-5B illustrate another non-specific aerosol-generating device 200. Like the devices depicted in FIGS. 3A-B and 4A-B, the device 200 depicted in FIGS. 5A-B includes a housing 210 defining a receptacle 220 configured to receive an aerosol-generating article comprising an aerosol-forming substrate. The housing 210 also defines an interior in which control electronics 250 and a power supply 240 are disposed. The device 200 also includes a sensor 260 configured to detect a state of the device 200 or an article associated with the device 200, such as when the article is received in the receptacle 220.

The device 200 depicted in FIGS. 5A-B includes a plurality of shape-changing elements 270 that configured to change the shape of the device 200 when activated. The control electronics 250 are operably coupled to the power supply 240, the sensor 260, and each of the shape-changing elements 270. In this embodiment, the control electronics 250 are coupled to the shape-changing elements 270 through a multiplexor 280.

The control electronics 250 are configured to permit power from the power supply 240 to activate one or more of the plurality of shape-changing element 270 when a predetermined state is detected by the sensor 260. Activation of the shape-changing elements 270 causes an exterior shape of the device 200 to change. Compare, for example, FIG. 5B in which some of the shape-changing elements 270 are activated to FIG. 5A in which none of the shape-changing elements 270 are not activated.

As shown in FIG. 5B, each shape-changing element 270 may be independently controlled by the control electronics 250. The shape-changing elements 270 may be the same or different. In some cases, such as shape-changing elements employing two-way shape memory alloys, activation of the shape-changing element may result in a full activation. In other cases, the amount of activation (e.g., application of heat) may result in partial activation of the shape-changing element. For example, application of less than full heating to a foam comprising gas bubbles may result in less than full (e.g., partial) activation of the element such that the element effects a change in shape of the device 200 to an extent less that the full change in shape that may be possible at maximum activation, as determined by, for example, instructions programmed in the control electronics 250.

FIGS. 6A-B illustrate an embodiment of a portion of the housing 210 of an aerosol-generating device. The housing 210 includes a structural base layer 212 and an exterior layer 214 sufficiently flexible to accommodate a change in shape of a shape-changing element 270, which is positioned between the base layer 212 and the exterior layer 214. The depicted shape-changing element 270 includes a heating element 272 such as a resistive wire mesh, which may be operably coupled to the control electronics and power supply through appropriate electrical connections (not shown). The shape-changing element 270 also includes a thermally-responsive shape-changing material 274 disposed on the heating element 272 and includes a movable part 276 disposed on the shape-changing material 274. Application of a current to the heating element 272 causes the temperature of the heating element 272 to increase, increasing the temperature of the shape-changing material 274, which causes a change in shape of the shape-changing material 274, which results in movement of the movable part 276. In the depicted embodiment, the shape-changing material 274 increases in volume when activated, which causes the movable part 276 to move beyond an original exterior edge of the exterior layer 214 of the housing, creating a bulge 216 or distinctive feature on the exterior surface that may be detected by touch or visually, as shown in FIG. 6B.

FIGS. 7A and 7B illustrate schematic top plan views of an embodiment of the portion of the housing 210 depicted in FIGS. 6A and 6B, respectively. As shown in FIG. 7A, the surface of the housing 210 has no distinctive external features when the shape-changing element is not activated. However, when the shape-changing element is activated, the external surface of the housing 210 changes shape to reveal a feature 216 having attributes of the shape-changing element, such as the shape of the movable part.

While the embodiment depicted in FIGS. 6A-B include a movable part 276, a change in shape of the device may be accomplished by a shape-changing element 270 without a moveable part 276. For example, the change in shape of the shape-changing material 274 itself may be sufficient to change the shape of the housing 210. However, the use of a movable part 276 may allow for more consistent changes in the shape of the device and may provide for more complex changes, such as the appearance of words, letters, or symbols. That is, a top surface of the shape-changing element may provide the words, letters, or symbols, and changes in shape of the shape-changing element may allow the words, letters, or symbols to appear or disappear, depending on the state of the device.

In some embodiments comprising a plurality of shape changing elements 270, each of the shape-changing elements 270 may comprise an end or a movable part that is shaped in the form of a letter or a number and that changes the exterior shape of the device 200 when the shape-changing element is activated. In these embodiments, activation of different ones of the shape-changing elements 270 may cause different words or numbers to be formed in an exterior face of the device. In other words, a word or a number may be raised or lowered in the surface of the device 200 by the activated shape-changing elements 270. Such words or numbers may be used to convey information to a user, such as the level of charge of the power supply, whether an aerosol-generating article is received in the receptacle 220 or the type or brand of aerosol-generating article received in the receptacle 220.

Referring now to FIGS. 8A-B and 9, exemplary non-specific aerosol-generating systems including aerosol-generating devices 200 and articles 100 are depicted in schematic form. The devices 200 includes a housing 210 defining a receptacle 220 configured to receive an aerosol-generating article 100 comprising an aerosol-forming substrate. The device housing 210 also defines an interior in which control electronics 250 and a power supply 240 are disposed. The device 200 also includes a sensor 260 configured to detect a state of the device 200 or the article 100.

The aerosol-generating article 100 includes a housing 110 and a shape-changing element 170. The shape changing element 170 is configured to electrically couple with the control electronics 250 of the device 200 when the article 100 is inserted into the receptacle 220. For example, the article 100 may include one or more electrical contacts (not shown) exposed through the article housing 110 that may couple with one or more electrical contacts (not shown) exposed through an internal surface of the receptacle 220 when the article 100 is received by the receptacle 220. The contacts (not shown) of the article 100 may be electrically coupled to the shape changing element 170. The shape changing element 170 of the article 100 is configured to change shape when activated by the control electronics 250. The shape-changing element 270 is arranged to change the shape of the article 100.

The control electronics 250 are operably coupled to the power supply 240, the sensor 260, and the shape-changing element 170. The sensor 260 is configured to detect a state of the device 200 or the aerosol-generating article 100, when the article 100 is disposed in the receptacle 220. The control electronics 250 are configured to permit power from the power supply 240 to be supplied to the shape-changing element 170 to activate the shape-changing element 170 when a predetermined state is detected by the sensor 260. Activation of the shape-changing element 170 causes an exterior shape of the article 100 to change. Compare, for example, FIG. 9B, in which the shape-changing element 170 is activated to FIG. 8A, in which the shape-changing element 170 is not activated. In the depicted embodiment, activation (such as application of an electrical current a voltage differential) of the shape-changing element 170, or a portion thereof, causes an increase in the volume of the shape-changing element 170, or a portion thereof, which causes a change in shape of the article 100. The shape-changing element 170 of the article 100 of FIGS. 8A and 8B is arranged to deform the housing 110 around the entire circumference the article 100, along a portion of the length of the article 100, and to change the exterior shape of the article 100.

The device 200 may include more than one sensor 260 positioned and configured to detect a state of the device 200 or article 100. For example, a sensor 260 may be operably coupled to the article 100 to monitor the amount of aerosol-forming substrate remaining in the article or the number of puffs taken on the article 100.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Any direction referred to herein, such as "top," "bottom," "left," "right," "upper," "lower," and other directions or orientations are described herein for clarity and brevity are not intended to be limiting of an actual device or system. Devices and systems described herein may be used in a number of directions and orientations.

The embodiments exemplified above are not limiting. Other embodiments consistent with the embodiments described above will be apparent to those skilled in the art.

The invention claimed is:

1. An aerosol-generating system comprising:

an aerosol-generating article having:

an article housing; and aerosol-forming substrate disposed in the article housing; and a device having:

a device housing defining a receptacle configured to receive the aerosol-generating article;

control electronics disposed in the device housing; and a sensor operably coupled to the control electronics and configured to detect a state of the device or the article when the article is received in the receptacle, wherein the system further comprises a shape-changing element disposed on or in at least one of the article housing and the device housing, wherein the control electronics are operably couplable to the shape-changing element and are configured to cause the shape-changing element to change shape in response to the state of the device or the article detected by the sensor, wherein the change in shape of the shape-changing element causes a sufficient change in shape of an exterior surface of the device or the article to provide tactile feedback to a user.

2. The aerosol-generating system according to claim 1, wherein the shape-changing element comprises a shape-changing material.

3. The aerosol-generating system according to claim 2, wherein the shape-changing material comprises piezoelectric material.

4. The aerosol-generating system according to claim 2, wherein the shape-changing material comprises a shape memory alloy.

5. The aerosol-generating system according to claim 2, wherein the shape-changing material comprises a foam comprising gas bubbles.

6. The aerosol-generating system according to claim 4, wherein the shape-changing element comprises an electrically resistive element operably couplable to the control electronics, wherein the electrically resistive element is in thermal proximity to the shape-memory alloy or the foam.

7. The aerosol-generating system according to claim 2, wherein the shape-changing material comprises an electroactive polymer.

8. The aerosol-generating system according to claim 2, wherein the shape-changing element comprises a movable part operably coupled to the shape-changing material, wherein a change in shape of the shape-changing material causes the moveable part to move.

9. The aerosol-generating system according to claim 1, wherein at least one of the article housing and the device housing comprises a base layer and an exterior layer on the base layer, and wherein the shape-changing element is between the exterior layer and the base layer.

10. The aerosol-generating system according to claim 1, wherein the control electronics are operably couplable to a heating element of the device or the article, and wherein the control electronics are configured to cause the heating element to heat the aerosol-forming substrate when the aerosol-generating article is received in the receptacle.

11. The aerosol-generating system according to claim 1, wherein the device comprises a plurality of shape-changing elements and wherein the plurality of shape-changing elements are operably couplable to the control electronics through a multiplexor.

12. The aerosol-generating system according to claim 1, wherein the shape-changing element changes one or more of a global shape of the exterior surface of at least one of the article and the device, a local shape of the exterior surface of at least one of the article and the device, and surface roughness of the surface of at least one of the article and the device.

13. The aerosol-generating system according to claim 1, wherein the sensor is configured to detect a parameter of the aerosol-generating article, and wherein the control electronics are configured to cause the shape-changing element to adapt a shape based on the detected parameter of the aerosol-generating article.

14. The aerosol-generating system according to claim 1, further comprising a power supply, wherein the sensor is configured to detect a charge level of the power supply, and wherein the control electronics are configured to cause the shape-changing element to adapt a shape based on the sensed charge level.

15. An aerosol-generating device comprising:

a housing defining a receptacle configured to receive an aerosol-generating article;

control electronics disposed in the housing; and a sensor operably coupled to the control electronics and configured to detect a state of the device or the article when the article is received in the receptacle, wherein the system further comprises a shape-changing element disposed on or in the housing, wherein the control electronics are operably couplable to the shape-changing element and are configured to cause the shape-changing element to change shape in response to the state of the device or the article detected by the sensor, wherein the change in shape of the shape-changing element causes an exterior surface of the device to change shape sufficient to provide tactile feedback to a user.

16. An aerosol-generating article for use with an aerosol-generating device, the article comprising:

a housing;

an aerosol-forming substrate disposed in the housing; and a shape-changing element disposed on or in the housing, wherein the shape-changing element is operably couplable to control electronics of an aerosol-generating device to cause the shape-changing element to change shape, wherein the change in shape of the shape-changing element causes an exterior surface of the article to change shape sufficient to provide tactile feedback to a user.

* * * * *